US006035598A

United States Patent [19]

Sukolics et al.

[11] Patent Number: 6,035,598

[45] Date of Patent: Mar. 14, 2000

[54] COMPOSITE PANEL ATTACHMENT SYSTEM

[75] Inventors: Ronald D. Sukolics, St. Louis, Mo.; Robert C. Schmidt, Smithtown, N.Y.

[73] Assignee: United Attachment Systems, Inc., Hauppauge, N.Y.

[21] Appl. No.: 09/081,093

[22] Filed: May 19, 1998

Related U.S. Application Data

[60] Provisional application No. 60/058,803, Sep. 15, 1997.

[51] Int. Cl.[7] ..... E04B 2/96

[52] U.S. Cl. ..... 52/506.08; 52/509; 52/510; 52/235; 52/482; 52/762; 52/772; 52/773; 52/779; 52/781; 52/631; 52/747.1

[58] Field of Search ..... 52/506.06, 506.08, 52/509, 510, 235, 482, 762, 769, 772, 773, 777, 779, 781, 475.1, 747.1, 385, 631, 792.1

[56] References Cited

U.S. PATENT DOCUMENTS

| | | | |
|---|---|---|---|
| 1,723,166 | 8/1929 | Hayman . | |
| 1,949,543 | 3/1934 | Louks | 52/506.08 |
| 2,116,530 | 5/1938 | McCabe . | |
| 2,134,999 | 11/1938 | Crouch | 85/631 |
| 2,325,528 | 7/1943 | McGowan | 52/631 |
| 2,877,877 | 3/1959 | Davis, Jr. | 52/509 X |
| 2,994,113 | 8/1961 | Dail | 52/506.08 |
| 3,002,591 | 10/1961 | Hess . | |
| 3,327,444 | 6/1967 | Downing, Jr. | 52/781 X |
| 3,412,514 | 11/1968 | Giovannucci . | |
| 3,440,790 | 4/1969 | Nerem | 52/631 |
| 3,453,794 | 7/1969 | Blok | 52/506.08 X |
| 3,557,507 | 1/1971 | Wilder . | |
| 3,590,543 | 7/1971 | Heirich . | |
| 3,623,290 | 11/1971 | Downing, Jr. | 52/762 X |
| 3,970,402 | 7/1976 | Yamashita . | |
| 4,091,588 | 5/1978 | Heirich . | |
| 4,192,117 | 3/1980 | Heirich . | |
| 4,344,267 | 8/1982 | Sukolics | 52/781 X |
| 4,452,029 | 6/1984 | Sukolics | 52/747.1 |
| 4,635,422 | 1/1987 | Nowack et al. . | |
| 4,641,475 | 2/1987 | Berridge . | |
| 4,829,740 | 5/1989 | Hutchison | 52/762 |
| 4,833,858 | 5/1989 | Hutchison | 52/762 |
| 5,204,149 | 4/1993 | Phenicie et al. . | |
| 5,215,802 | 6/1993 | Kaars Sijpesteijn . | |
| 5,263,292 | 11/1993 | Holland et al. | 52/235 |
| 5,579,624 | 12/1996 | Aeberhard | 52/482 X |
| 5,644,878 | 7/1997 | Wehrmann | 52/482 X |
| 5,809,729 | 9/1998 | Mitchell | 52/762 X |

FOREIGN PATENT DOCUMENTS

| | | | |
|---|---|---|---|
| 250327 | 5/1963 | Australia | 52/506.08 |
| 395483 | 12/1965 | Switzerland | 52/506.08 |

OTHER PUBLICATIONS

Universe® 2000 Brochure, pre–Sep., 1997 (best available copy).

*Primary Examiner*—Laura A. Callo
*Attorney, Agent, or Firm*—Fitzpatrick, Cella, Harper & Scinto

[57] ABSTRACT

The present invention provides a system for attaching a panel to a building wall using an elongated channel. The panel has a main panel portion, a panel edge portion and a groove therebetween. The elongated channel has a body and a pair of rails. The body is attachable to the wall by a fastener. The pair of rails are integrally formed with the body, extending substantially perpendicularly from the body in the same direction. One, or both, of the rails ends in a flange that is contoured to engage the cavity formed by the groove when the panel edge portion is bent around the groove and toward the rail.

6 Claims, 22 Drawing Sheets

COMPOSITE PANEL ATTACHMENT SYSTEM

CROSS-REFERENCE TO RELATED APPLICATIONS

This application claims the benefit of, and incorporates by reference the entirety of, U.S. Provisional Application No. 60/058,803, filed Sep. 15, 1997.

BACKGROUND OF THE INVENTION

1. Field of the Invention

This invention is in the field of attachment systems for composite panels and the like.

2. Description of Related Art

The exterior walls of a building, or any other building-like structure, may be made of concrete block or other exterior finishes. Those walls, however, are generally unattractive, and may not be water tight and weather resistant. Consequently, the architect or builder will choose to cover them with an attractive, weather-resistant siding. Alternatively, the building may be composed of stud-formed walls, the interior of which are finished with sheetrock or the like, and the exterior of which are unfinished so that the studs are exposed. In this case, the builder needs to attach an exterior siding to the studs to finish the walls. Likewise, worn exterior walls of new or old buildings may be finished or refaced with a new siding.

One such exterior wall siding that is used by builders and architects is a composite panel. Composite panels provide the building with an attractive finish, improved weather resistance and water tightness, and increased insulation value when used in conjunction with insulation. They also bend, and are thus well-suited for covering curved walls. A composite panel is generally formed of two or more materials. For example, an Alpolic® or Alucobond® composite panel is made of a thin aluminum skin, having a thickness of between twenty to thirty thousandths of an inch, that is bonded to both sides of a thermoplastic core, for a total of thickness of 3–6 mm. Composite panels are typically rectangular, and can be manufactured to the desired length and width to suit the overall design. For example, a typical panel is about 4 feet in width and 8 feet in length. Of course, other shapes and dimensions are possible. Additionally, the panels may be used on interior wall structures.

Various components and systems are currently known and used for attaching composite panels to exterior building walls. In one such known system, called a "glazed in system", the panels are attached to the building as would be a pane of glass. A cross-section view of a horizontal joint of this system, is shown in FIG. 1. A female extrusion bracket 100 is fastened to the sub girt 101 of the wall or stud 107 with a fastener 106, with a leveling shim 102 therebetween. A male extrusion bracket 103 holds composite panels 105*a* and 105*b* against the female extrusion bracket 100, after gaskets 104 have been installed between the extrusion brackets 100 and 103 and the panels 105*a* and 105*b*.

A cross-section view of another system, typically called an edge-grip system, is shown in FIG. 2. In this system, an I-shaped extrusion bracket 120, comprising a vertical spine 120*a*, a top horizontal gutter 120*b* and a bottom horizontal gutter 120*c*, is fastened through shims 126 to a sub girt 121. Side rails 122 and 123 are respectively attached, using structural adhesive tape 128 and structural silicone 129, to the edges of the composite panels 124*a* and 124*b*, which have been machined in tongue-and-groove fashion to receive the side rails. Side rails 122 and 123 are inserted between the top and bottom horizontal gutters 120*b* and 120*c* of the I-shaped extrusion bracket 120. Gaskets 125 are positioned between the gutters 120*b* and 120*c* and the side rails 122 and 123 to provide a water tight seal. Upon installation, the panels are about ½ inch apart at the joint and 2⅜ inches away from the wall.

Another type of panel attachment system is called a "route-and-return system". FIG. 3 shows in cross-section, an edge-grip route-and- return system, which uses an extruded channel 130. A female portion 131 of the channel 130 has a composite panel 132 riveted thereto. The end of the panel 132 consists of two edges 132*a* and 132*b*, the first edge 132*a* being perpendicular to the face 132*c* of the panel, and the second edge 132*b* being perpendicular to the first edge 132*a*. The second edge 132*b* is inserted into and riveted with rivet 134, at the factory, to the female portion 131. The channel 130 and panel 132 attached thereto are positioned and screwed to the sub girt 135, on site, using screw 133. A second panel 136 has an edge 136*a*, perpendicular to the face 136*b* of the second panel, which is factory riveted to a female extrusion bracket 137. The female extrusion bracket 137 is hooked over a male portion 138 of the channel 130.

The above attachment systems have numerous disadvantages. First, they all require complicated, lengthy and costly ways of attaching the panels to the extrusion brackets and ultimately to the exterior walls. Further, in certain systems, some of the attachment work must be first performed at the factory, which reduces the flexibility of later on-site installation. The following route-and-return systems simplify the attachment of the composite panels to the extrusion brackets, and are thus less costly, quicker and more flexible.

For example, FIG. 4 shows a cross-section view of a route-and-return system, and in particular a vertical joint in this system. In this vertical joint, a metal clip 140 is fastened with fasteners 141 to the sub girt 142 of the exterior wall 143. To permit leveling adjustments to be made to the panel, the metal clip 140 is shimmed to the wall by placing a shim 144 between the metal clip 140 and the sub girt 142. The metal clip 140 is substantially I-shaped in cross-section, and runs at least the length of the composite panels 145*a* and 145*b* (or at least the width for horizontal joints). The larger flange of the "I" attaches to the sub girt 142, while the smaller flange of the "I" engages the attachment system extrusion brackets 146*a* and 146*b*. Each composite panel is routed to form an approximate ⅛ inch depth groove 147, although in general groove depth may vary depending on the panel thickness. Those grooves are formed, for example, an inch or two away from the side edges of the panel. Thus, each panel has four grooves. The corner pieces of the panel, at which the grooves intersect, are removed. This allows the panel edges 148*a* and 148*b* to be turned down around the groove 147 and away from the main panel portions 145*a* and 145*b*, respectively, to form down-turned edges. Bracket 146*a* is fastened to the down-turned edge 148*a* of the panel, and bracket 146*b* to the down-turned edge 148*b*, by screws or other fasteners 149. Each bracket is held against the metal clip 140 by pressure from the other three attached sides of the panel. The installation is completed by adding a standard backing rod 150, which is positioned between the down-turned edges 148*a* and 148*b* and over the smaller flange metal clip 140. The backing rod 150 is made of polyvinyl or other plastic and backs up the flexible water-resistant sealant 151 applied thereon.

A cross-section view of a horizontal joint of another route-and-return system is shown in FIG. 5. This system uses male and female extrusion brackets, 161 and 160, to attach respectively first and second composite panels, 162 and 163, to a wall 164. The female extrusion bracket 161 is screwed to the wall 164 through shims 165. A one-inch down-turned edge 162*a* of the first composite panel 162 is screwed to the female extrusion bracket 161 with screw 166. Similarly, a down-turned edge 163*a* of the second composite panel 160 is screwed to the male extrusion bracket 160. The male extrusion bracket 160 is inserted into, and held in place by, the female extrusion bracket 161. The panels attachment is completed by inserting a standard backer rod 168 between the down-turned edges 162*a* and 163*a* of the composite panels 162 and 163, and applying a flexible sealant 169 thereon. Upon installation, the panels are approximately 2¼ inches from the wall, and approximately ½ inch apart at the joint.

Another route and return panel attachment system is shown in FIGS. 6A–6D. FIG. 6A depicts a cross-section of a horizontal joint, in which a female extrusion bracket 170 is screwed to the wall 172 using screw 173, with shims 171 therebetween. The down-turned edge 174*a* of a first panel 174 is riveted, using pop-rivet 176, to a first male extrusion bracket 175, while the down-turned edge 177*a* of a second panel 177 is riveted to a second male extrusion bracket 178. The male extrusion brackets 175 and 178 are each hooked over portions 170*a* and 170*b*, respectively, of the female bracket 170. FIG. 6B shows a vertical joint, in which extrusion brackets 181 and 182 are respectively riveted to the down-turned edges 174*b* and 177*b* of panels 174 and 177. Extrusion brackets 181 and 182 are held against the wall by bracket 183, which is screwed to the wall 172 through shims 184. FIGS. 6C and 6D respectively show single-panel horizontal head and vertical jamb joints. The horizontal head joint uses a single male extrusion bracket 190 to hold a single panel 191 via edge 191*a* riveted thereto. The male extrusion bracket 190 is hooked into a female extrusion bracket 192 which has already been attached to the wall 172 through shims 193. In the vertical jamb joint, a down-turned edge 197*a* of a single panel 197 is riveted to a male extrusion bracket 198. The male extrusion bracket hooks into a female extrusion bracket 199 which has been screwed to the wall 172. In these joints, a standard vinyl backer rod 179 and flexible sealant 180 may be used to fill the ⅝ inch gap between the panel edges (FIGS. 6A and 6B), between the panel edge and coping 195 (FIG. 6C) or between the panel and jamb 196 (FIG. 6D).

The above-described route-and-return systems, however, all require fastening the panels to the extrusion brackets with screws or rivets. This is a lengthy process which adds to the cost of the installation.

Another route-and-return system, marketed as the "Universe® System, is shown in FIGS. 7A and 7B. This system attempts to solve the above problems by using a screwless attachment device. FIG. 7A is a cross-section view of this system. The attachment device 200 runs the length of the panel and is attached by screw 209 through one or more plastic shims 201 to a wall or stud 202. Device 200 has two rails with rounded, inward-facing ends 200*a*. The composite panels 204 and 205 have, in addition to the routed grooves 203 around which the edges 204*a* and 205*a* are turned down, a routed groove 206 on the down-turned edge itself. The rounded ends 200*a* of the attachment device 200 are inserted into the panel edges 204*a* and 205*a*. Thus, the panels are held in place by the rounded ends of the rails rather than screws or rivets. A vinyl backer rod 207 is inserted between the down-turned edges 204*a* and 205*a*, upon which sealant 208 is applied. A perspective view of the same system is shown in FIG. 7B.

The prior attachment system requires, however, extra grooves to be routed in the down-turned edges of the panels to engage with the rounded ends of the rails. Moreover, the rounded rails do not completely or positively interlock with the panels.

SUMMARY OF THE INVENTION

It is one objective of the present invention to provide an improved system for attaching composite panels to exterior or interior wall structures.

It is another objective to provide a composite panel attachment system that does not require the use of screws or rivets to hold composite panels to a formed channel.

It is still another objective to provide a composite panel attachment system which provides a complete, positively interlocking attachment between the panels and the formed channel.

In one aspect of the present invention, a panel is provided that has a main panel portion, a panel edge portion, and a groove therebetween. The panel edge portion may be bent around the groove toward the main panel portion to form a cavity. The groove has a plurality of surfaces, the cavity's wall being formed by the plurality of surfaces.

In another aspect of the present invention, an elongated channel is provided for attaching the panel to a wall. The elongated channel has a body and a pair of rails. The body is attachable to the wall by a fastener. The pair of rails are integrally formed with the body, extending substantially perpendicularly from the body in the same direction. One, or both, of the rails ends in a flange that is contoured to engage the cavity formed by the groove when the panel edge portion is bent around the groove and toward the rail. In one embodiment, the flange is a hook projecting inward of the rail and toward the body. In another embodiment, the flange is substantially cylindrical in shape and projects from the rail.

One or more panels and the channel form an attachment system. This system may further include an insert that is inserted between the two rails after the panel or panels have been positioned in the channel. Also, a backing rod may be inserted over the insert, and a flexible sealant may be applied over the backing rod.

In another aspect of the present invention, a method for attaching a panel to a wall using an elongated channel is provided. The body of the channel is first fastened to the wall using a fastener. The panel edge portion is partially bent around the groove and toward the main panel portion, and then inserted between the pair of rails so that the flange of the rail abuts the groove. The panel edge portion is then further bent around the groove and toward the rail so as to engage the flange.

In still another aspect of the present invention, a method of routing a groove in a panel is provided. An inner groove portion is routed, to a desired length, in the first side of the panel. The inner groove portion is routed to a depth substantially approaching the second side of the panel. While the inner groove portion is being routed, an outer groove portion is also being routed on top of and coincident to the inner groove portion. The outer groove portion is wider than the inner groove portion and less deep than the inner groove portion.

BRIEF DESCRIPTION OF THE DRAWINGS

The various aspects of the present invention can be best understood by reference to the detailed description of the preferred embodiments set forth below taken with the drawings, in which.

DETAILED DESCRIPTION OF THE PREFERRED EMBODIMENTS

The invention includes the various components, which when used together form a composite panel attachment system that overcomes the problems associated with the conventional composite attachment systems described above, and especially those problems associated with the conventional route-and-return composite panel attachment systems.

Figure 1:
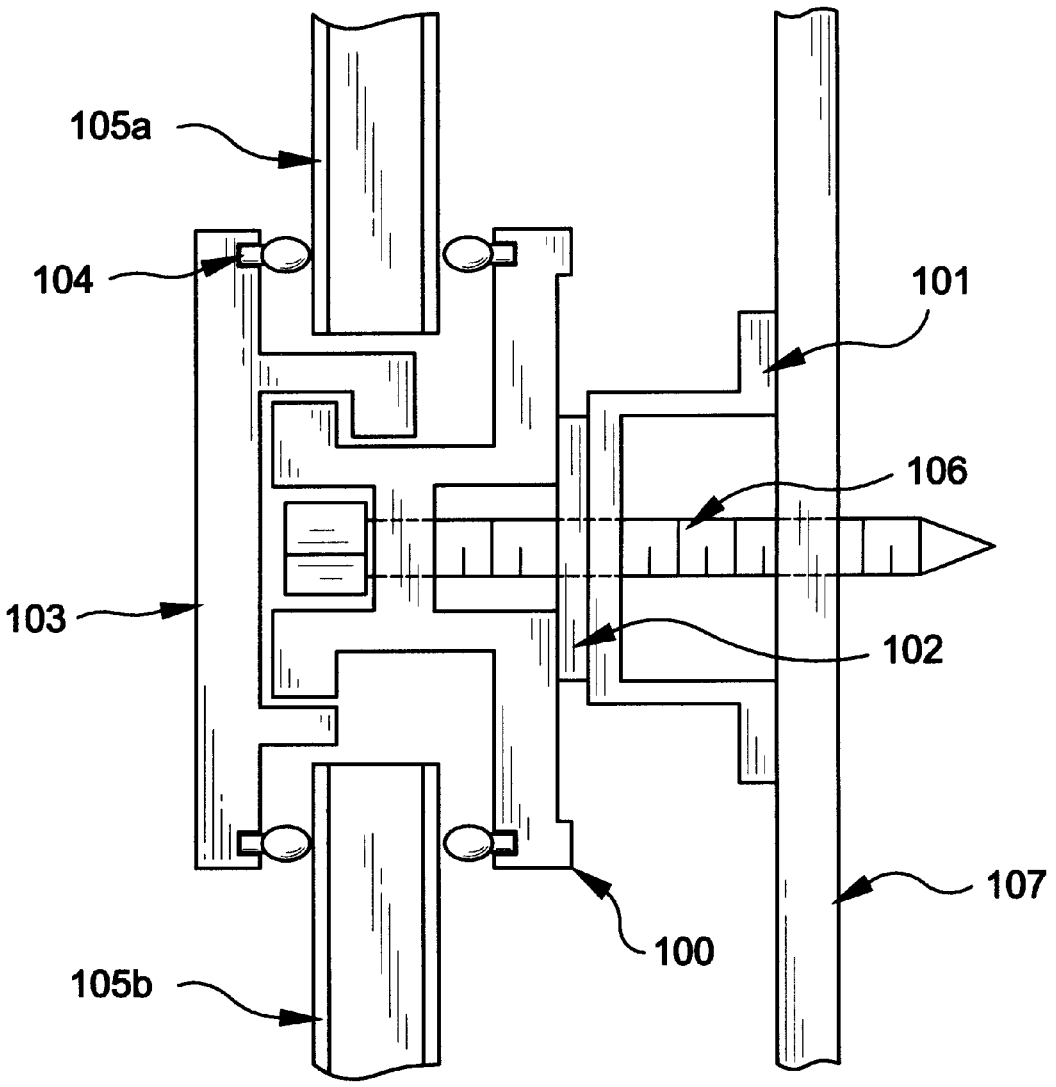
FIG. 1 PRIOR ART
FIG. 1 is a cross-section view of a first type of conventional attachment system.
Figure 2:
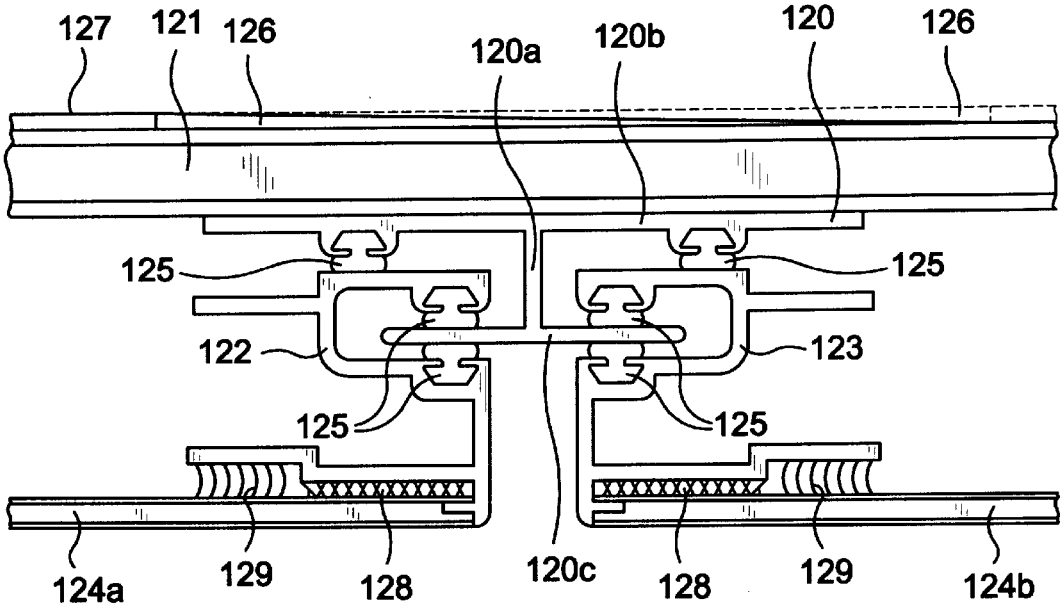
FIG. 2 PRIOR ART
FIG. 2 is a cross-section view of a second type of conventional attachment system.
Figure 3:
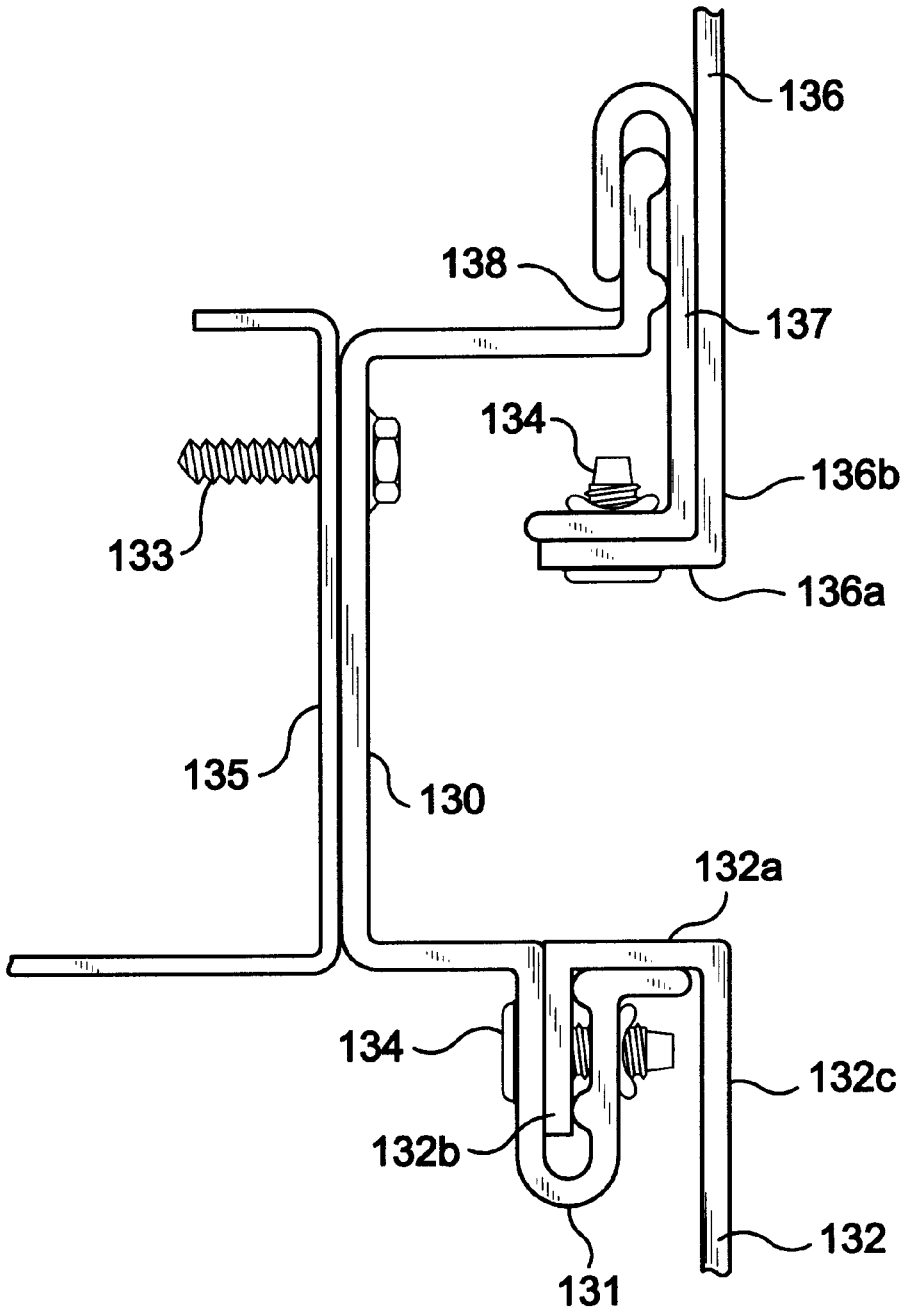
FIG. 3 PRIOR ART
FIG. 3 is a cross-section view of a conventional edge-grip route-and-return attachment system.
Figure 4:
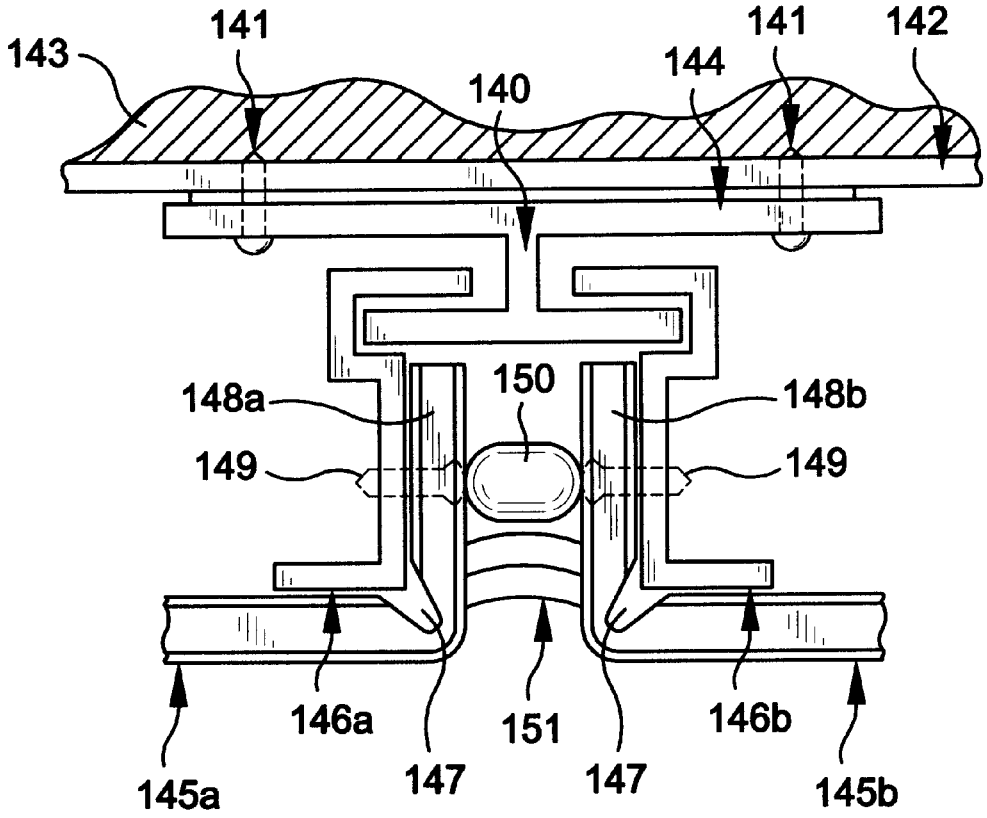
FIG. 4 PRIOR ART
FIG. 4 is a cross-section view of another conventional route-and-return attachment system.
Figure 5:
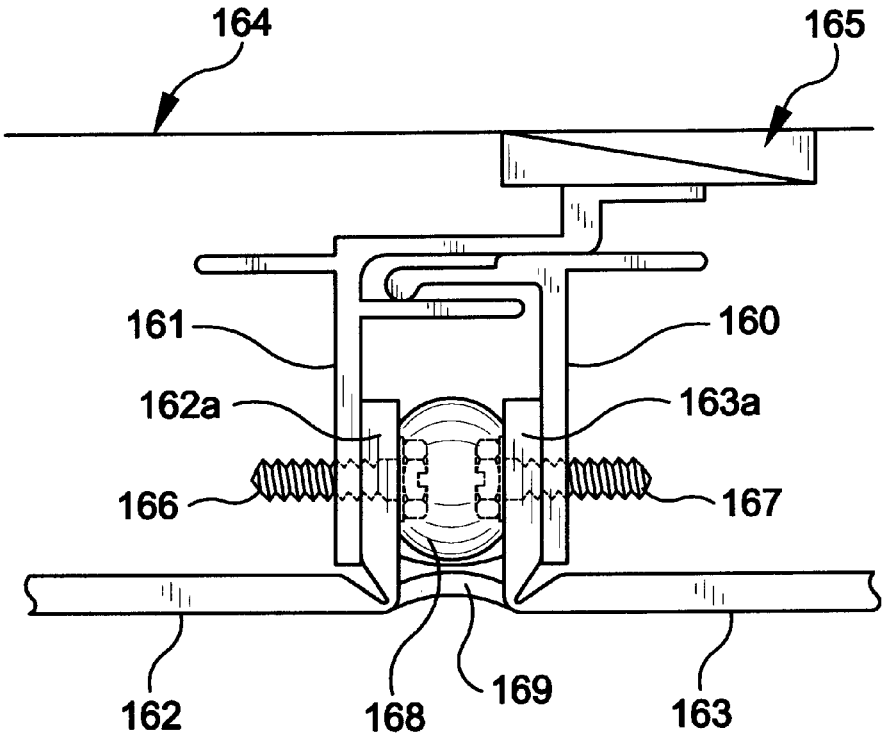
FIG. 5 PRIOR ART
FIG. 5 is a cross-section view of another conventional route-and-return attachment system.
Figure 6A:
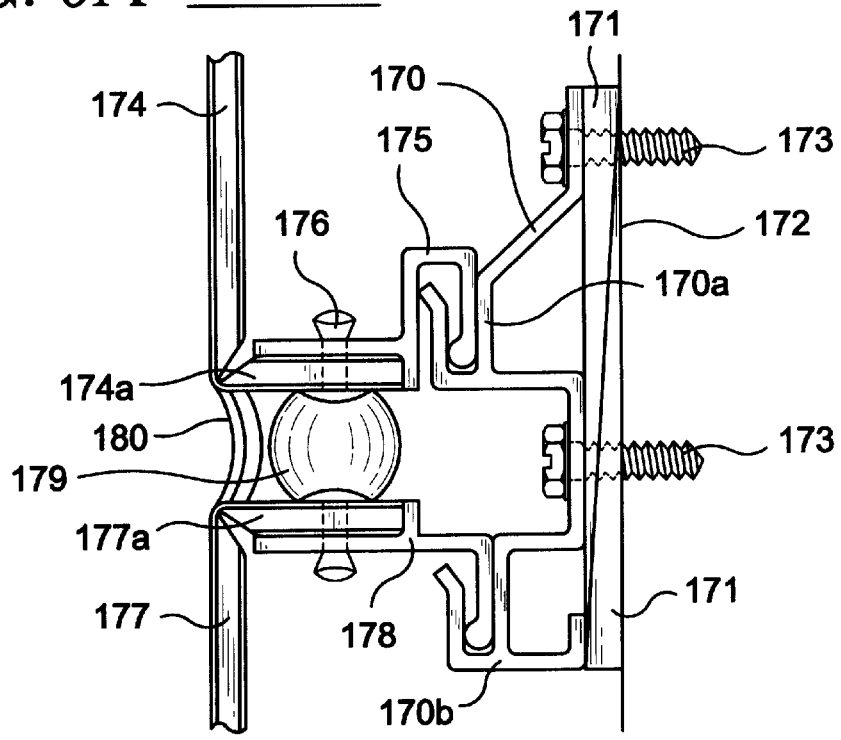
FIG. 6A PRIOR ART
FIGS. 6A–6D are cross-section views of yet another conventional route-and-return attachment system.
Figure 6B:
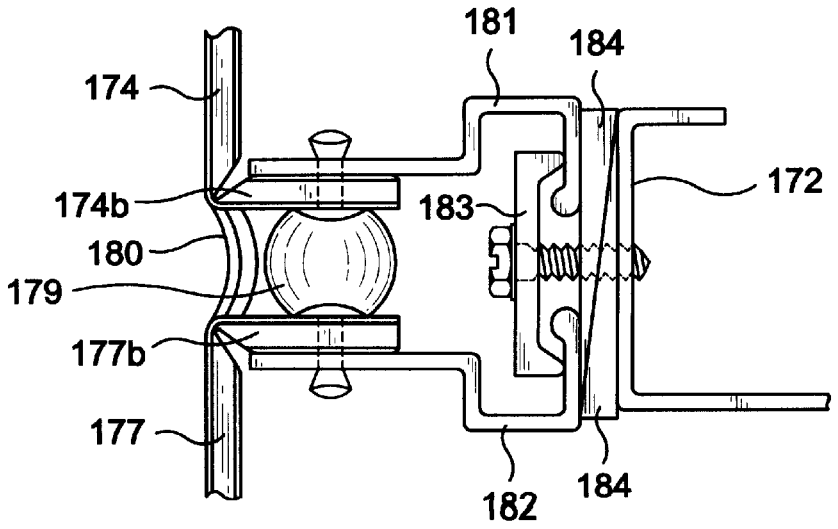
FIG. 6B PRIOR ART
Figure 6C:
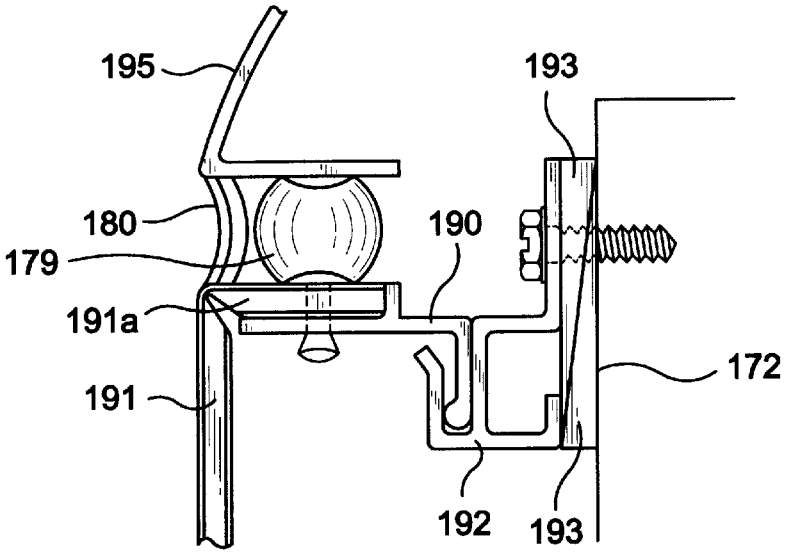
FIG. 6C PRIOR ART
Figure 6D:
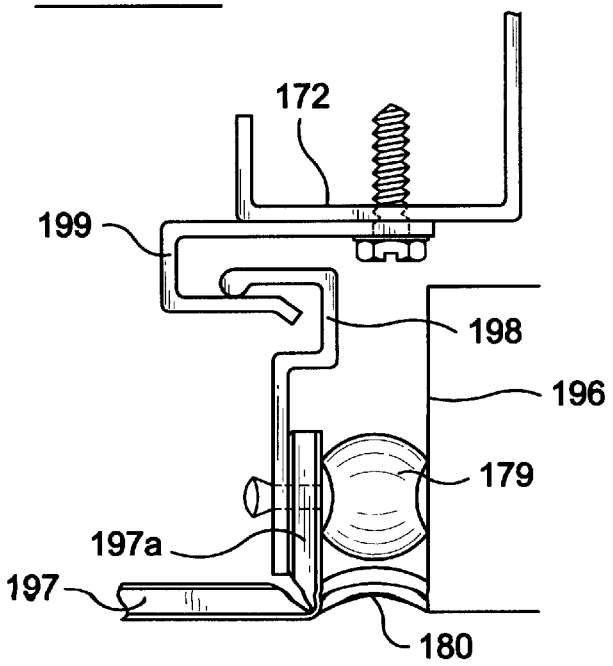
FIG. 6D PRIOR ART
Figure 7A:
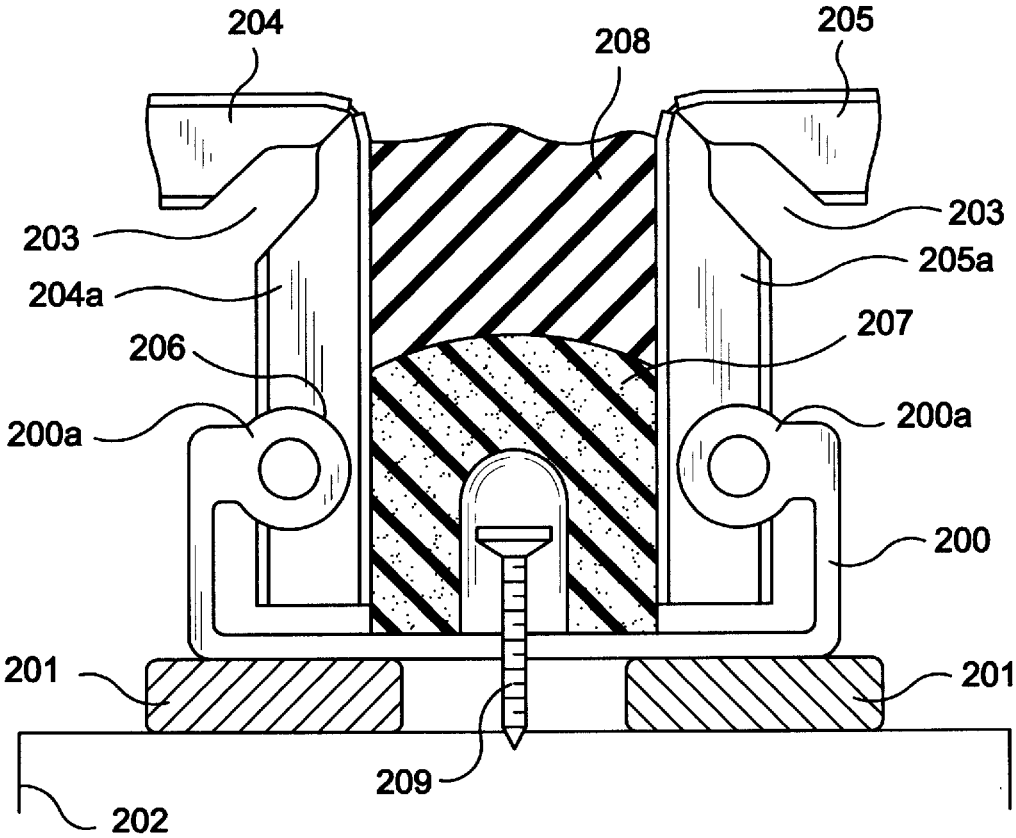
FIG. 7A PRIOR ART
FIG. 7A is a cross-section view of still another conventional route-and-return attachment system.
Figure 7B:
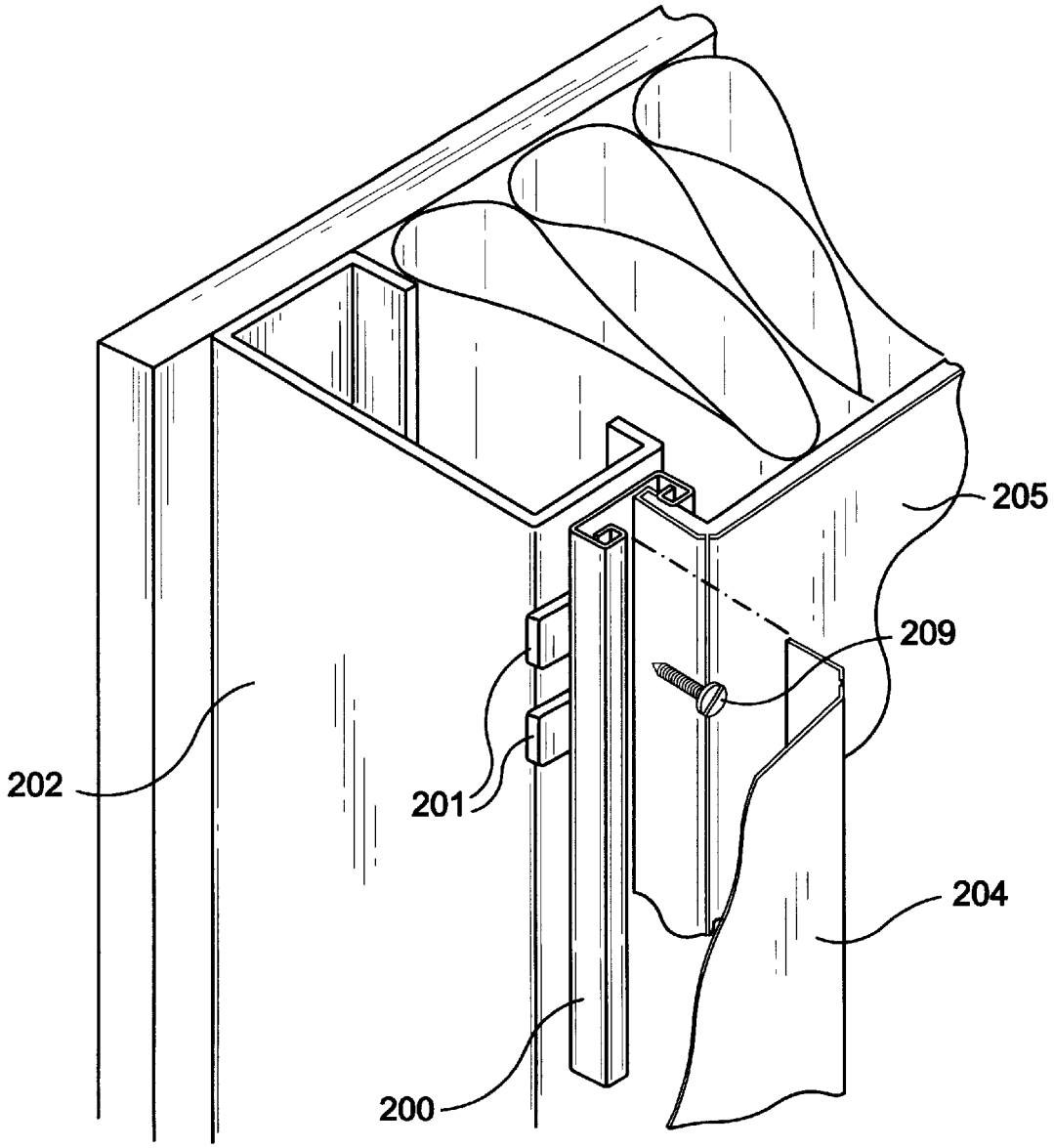
FIG. 7B PRIOR ART
FIG. 7B is a perspective view thereof.
Figure 8A:
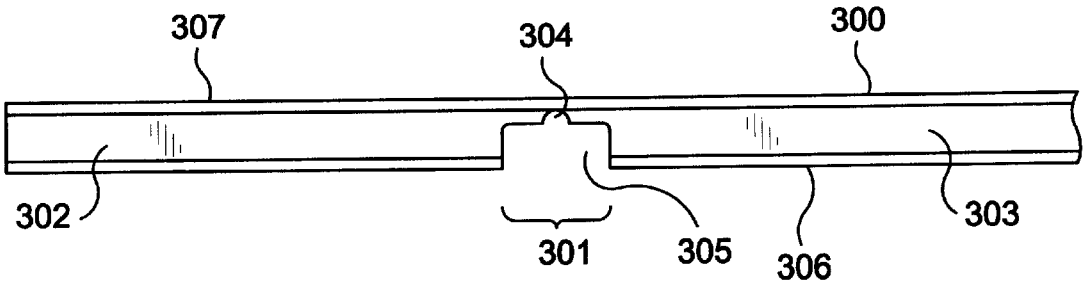
FIGS. 8A–8C are cross-section views of a composite panel according to the present invention.
Figure 8B:
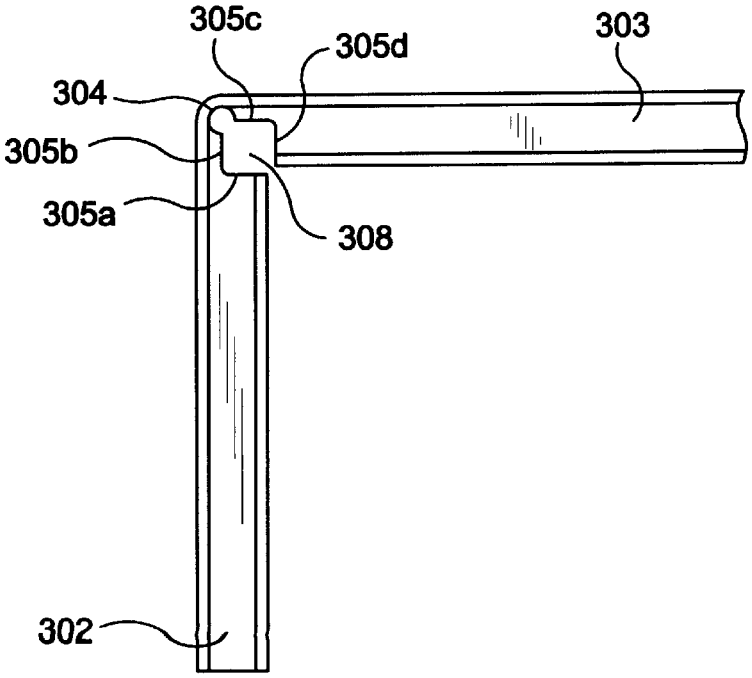
Figure 8C:
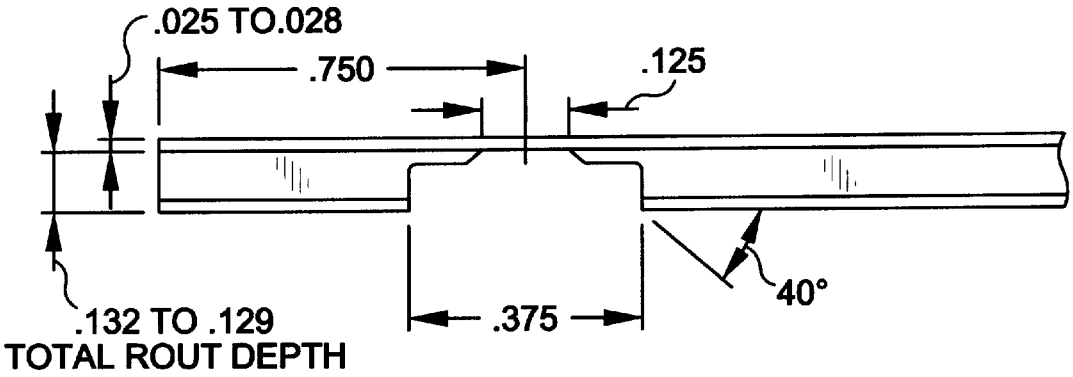

One component of the present invention is a composite panel 300, shown in cross-section in FIGS. 8A–8C. As shown in FIG. 8A, the composite panel 300 includes a modified groove 301, one or more edge panel portions 302, and a main panel portion 303. The composite panel is formed of the same materials as those described in the Background Section, or any other known substitutes therefor. The modified groove 301 consists of an inner groove portion 304 and an outer groove portion 305, both of which are simultaneously routed into the "inner" panel surface 306, that is, the panel surface which is eventually mounted facing the wall (the "outer" panel surface 307 being that which is exposed, as shown in FIG. 9).

Exemplative layout dimensions of the panel are shown in FIG. 8C. The modified groove 301 is positioned about 0.750 inches from the side edge of the panel. The inner groove portion 304 is routed to a total groove depth of about 0.129 to 0.132 inches and has a substantially trapezoidal cross-sectional shape. The beveled side of the inner groove portion is about 40° from perpendicular. The inner groove portion 304 provides the same function as the groove of the conventional composite panel, that is, to allow the panel installer to form a down-turned edge by turning the edge panel portion 302 toward the inner surface 306 of the main panel portion 303. The inner groove portion has a width of about 0.175 inches. The outer groove portion 305 is preferably substantially rectangular in cross-section, and is routed to a width of approximately 0.375 inches and to a depth within 0.025–0.028 inches of the total groove depth. The total groove depth may vary in accordance with panel thickness.

The outer groove portion permits the panel to engage in a positive and complete fashion with the channel described below, because the sides 305*a*, 305*b*, 305*c* and 305*d* of the outer groove portion form a cavity 308 when the edge panel portion 302 is bent toward the main panel portion 303, as shown in cross-section in FIG. 8B. The length (the direction into the drawing sheet) of the inner groove portion and the outer groove portion, and thus the cavity 308, is the same as the length (or width) of the panel.

Figure 9:
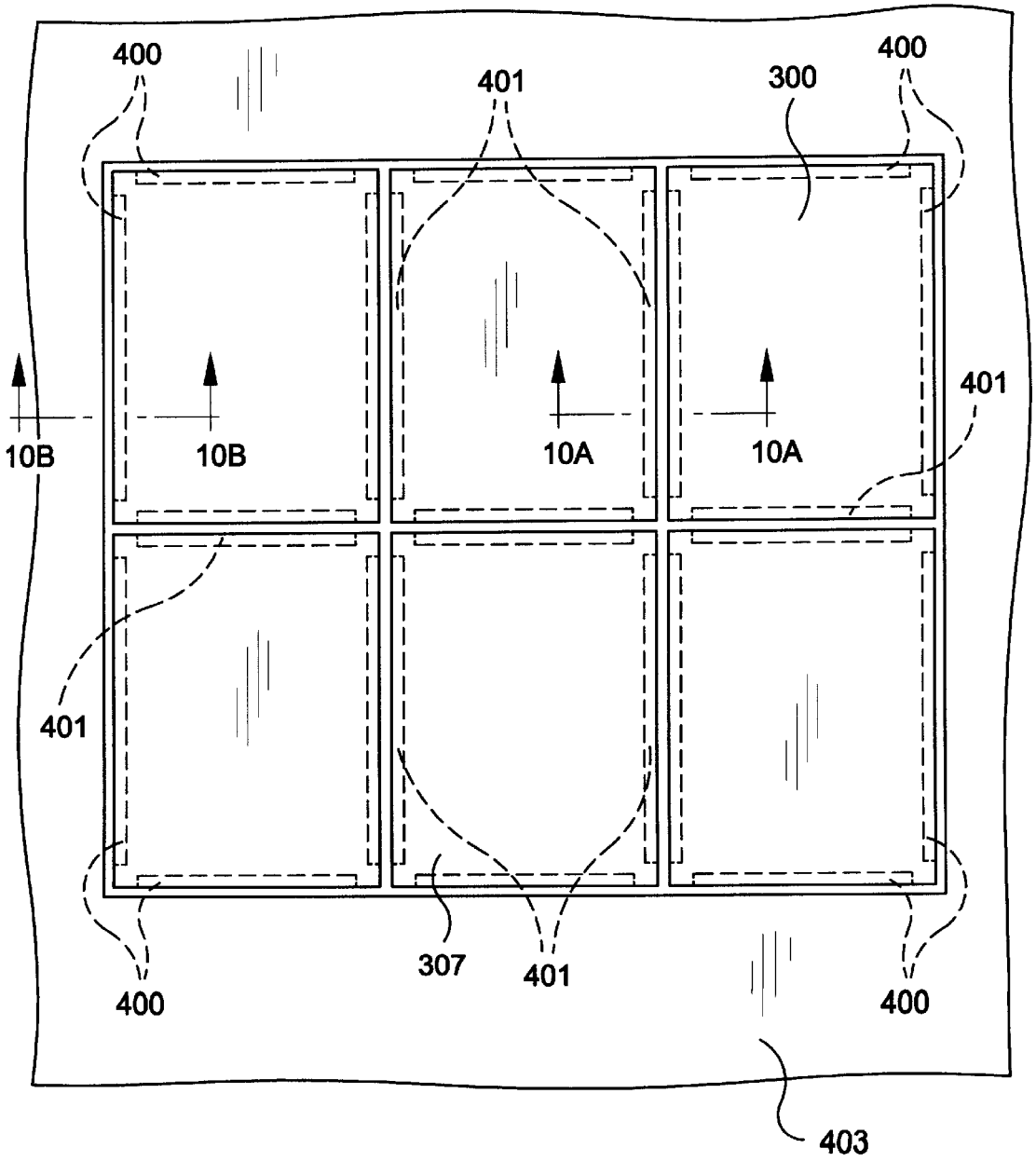
FIG. 9 is an elevation view of a composite panel application according to the present invention.

FIG. 9 is an elevation view of an installation of six composite panels 300 onto a building 403. The installation includes single panel joints 400 at top, bottom, right and left sides of the installation, and double panel joints 401 in the interior of the installation.

Figure 10A:
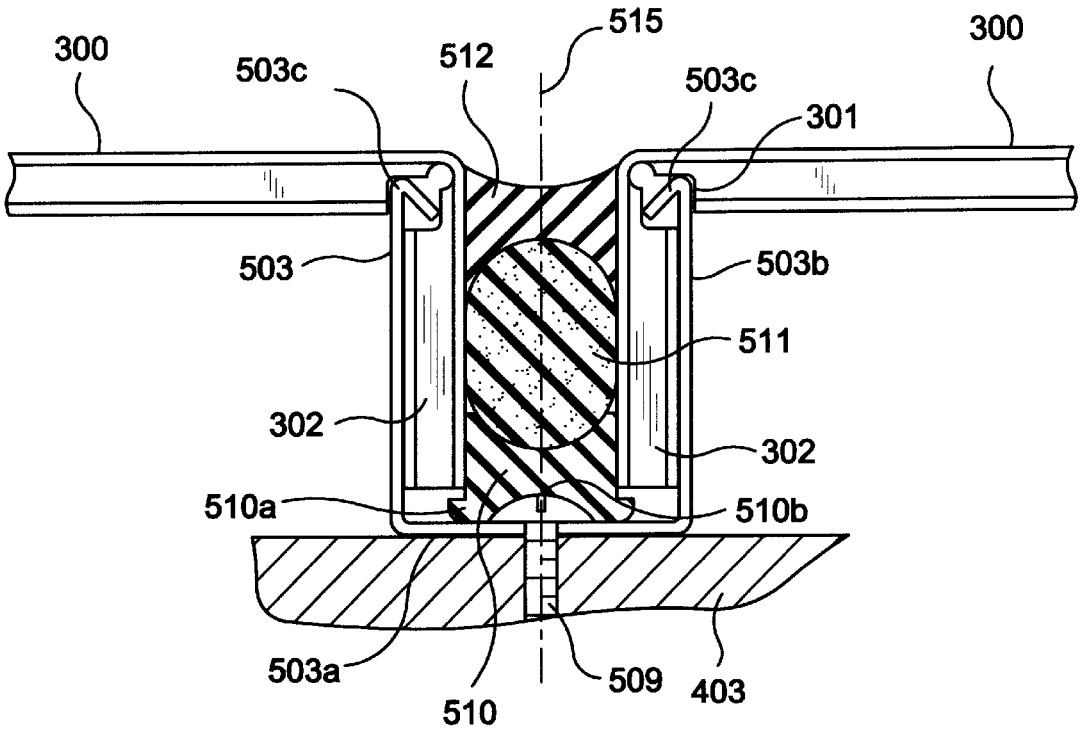
FIG. 10A is a cross-section view of a double panel joint according to the present invention.

FIG. 10A is a cross-section view of a double panel joint shown in FIG. 9. A one-piece channel 503 is used to attach the composite panels 300 to a wall 403. The channel 503 is preferably made of a thin-gauge stainless steel, preferably 24 gauge (0.0239 inches), which gives the channel a spring-like characteristic and strength. Other thinner or thicker gauges of steel may also be used. Moreover, stainless steel is compatible with building wall materials, such as metal studs, thus preventing deterioration that might otherwise be caused by corrosion or electrolysis. In addition, common steel with any non-corrosive coating may also be used to form the channel.

The channel includes a body 503*a*, which is attachable to the sub girt of the wall or a stud (hereinafter, all will be identified as simply as the "wall" 403), with or without shims therebetween, preferably by using non-corrosive fasteners 509. The length of the channel body 503*a* may extend the length or width of the panel for vertical and horizontal joints, respectively, or may run longer or shorter. The width of the channel body 503*a* may vary depending on the overall panel design on the building and on the total thickness of the composite panel. For example, a body width of about ¾ inches is used for a 4 mm panel thickness. Fastening holes (not shown) are provided in the channel body 503*a*, preferably positioned over the channel centerline 515, and through which the fasteners 509 are inserted during attachment of the channel 503 to the wall.

The channel has a pair of hook-ended rails 503*b*, each of which is integrally formed with the channel body 503*a* to form a substantially U-shape channel 503. The rails 503*b* extend substantially the length of the body. At the ends of the two rails are the hooks 503*c*. The hooks 503*c* project downward toward the channel body 503*a* and inward toward the channel centerline 515. The hook 503*c* engages the cavity 308 that is formed by modified groove 301 when the panel edge portion 302 is bent toward the main panel portion 303 until it abuts the channel rail 503*b*, as shown in FIGS. 10A, 10B, 11A and 11B.

Figure 15:
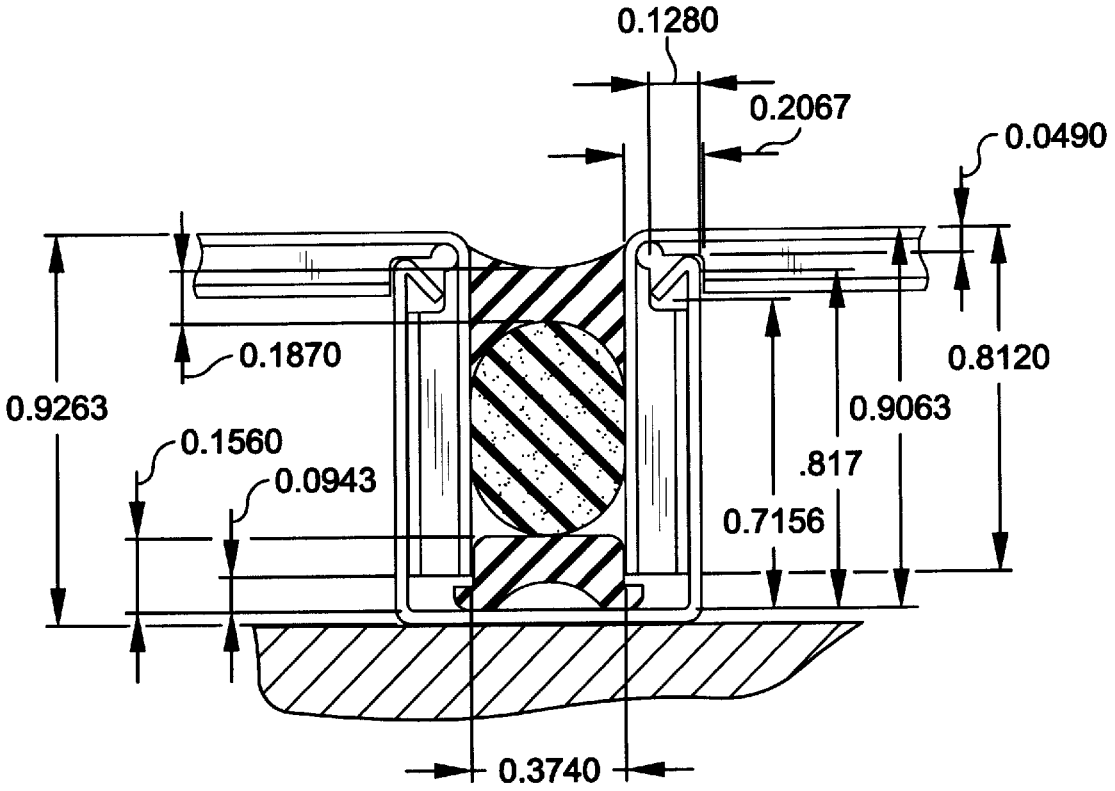
FIG. 15 shows an exemplative layout dimensions of a double panel joint.

As shown in FIG. 10A, an insert 510, preferably made of plastic or stainless steel, is wedged or otherwise inserted between the down-turned edges 302 of the panels 300. The insert 510 may have a flange 510*a* which positions the bottom of the insert below the bottom of the panel edge 302. Also, the insert has a cut-out portion 510*b* between the flanges 510*a* so that the insert can be positioned over the fastener 509. Inserts may be intermittingly spaced apart, for example, six inch pieces between fasteners, or may comprise a single insert running the length or width of the channel. The insert presses against the down-turned edges 302. This in turn forces the down-turned edges 302 against the respective channel rails 503*b*. A vinyl backer rod 511 is inserted into the channel over the insert 510. A flexible sealant 512 is applied over the backer rod 511 to provide a water-tight panel joint. Exemplative layout dimensions (in inches) for a double panel joint are shown in FIG. 15 (not drawn to scale).

Figure 10B:
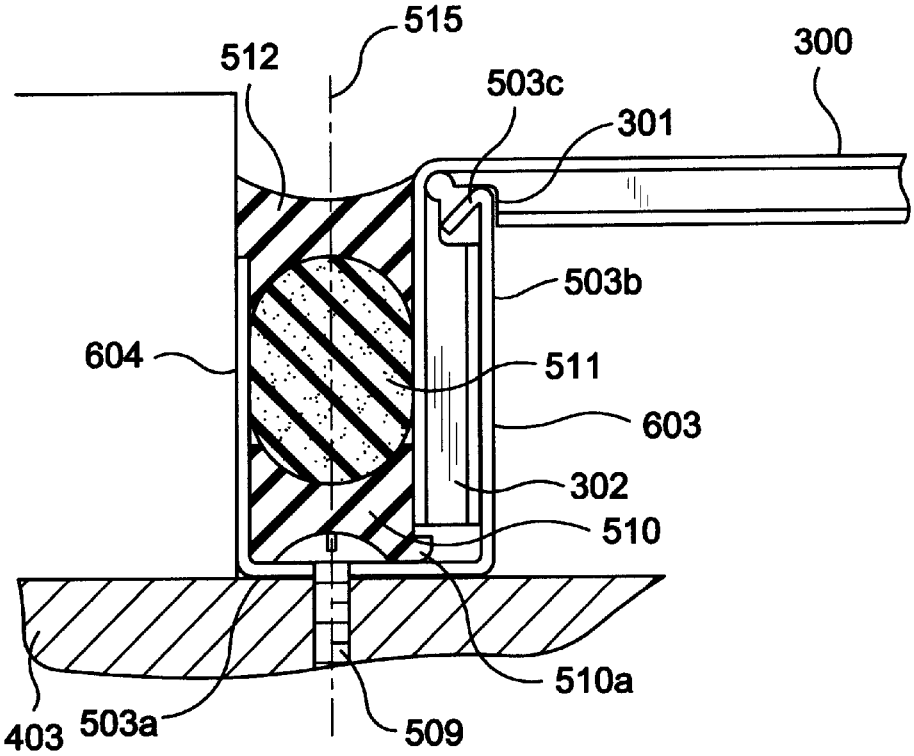
FIG. 10B is a cross-section view of a single panel joint according to the present invention.
Figure 11A:
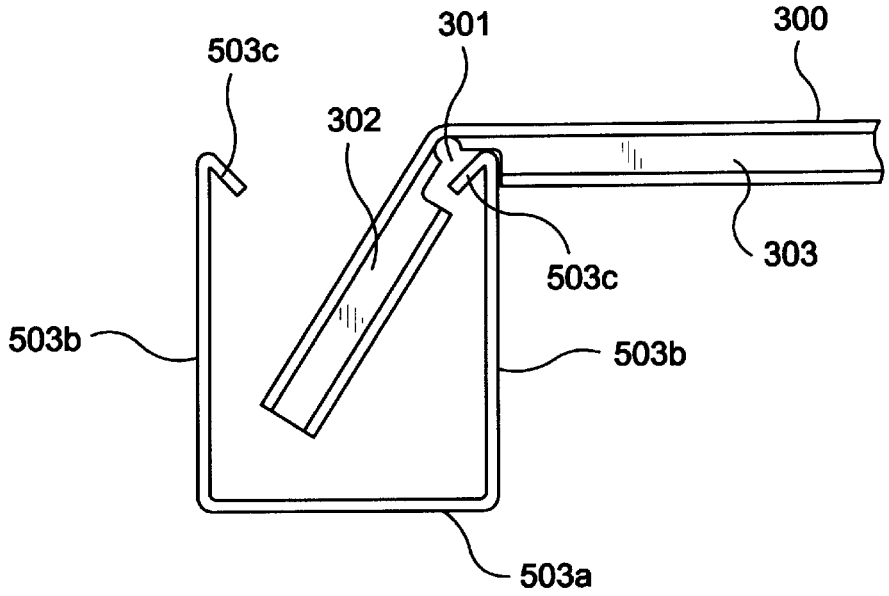
FIGS. 11A and 11B are cross-section views of a channel and panels engaging in a double panel joint according to the present invention.
Figure 11B:
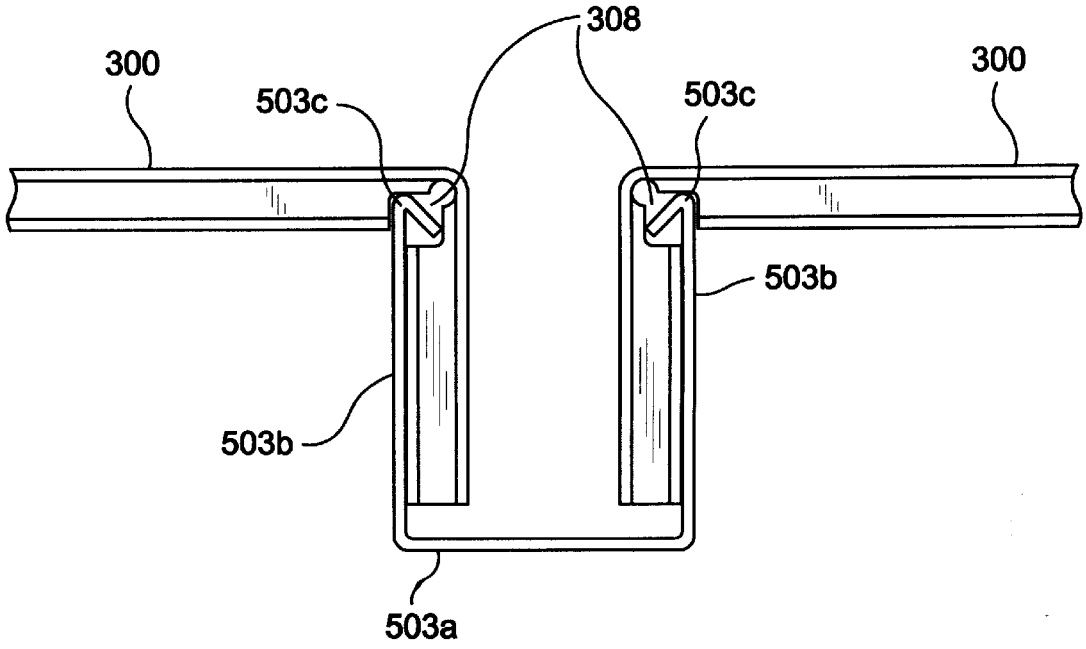

FIG. 10B is a cross-section view of a single panel joint shown in FIG. 9. A one-piece channel 603 is used to attach the composite panels 300 to a wall 403. The channel 603 is similar in structure to the channel 503 described above, except that instead of having two hook-ended rails 503*b*, it only has one hook-ended rail 503*b* and a leg 604. The leg 604 abuts a side edge of the wall 403 to provide support for the joint. In addition, the single panel joint may use a single-flanged insert 610, the flange 510*a* inserted beneath the down-turned edge 302 of the single panel 300. The side wall end of the insert may be rounded to fit snugly against the junction of the channel base 503*a* and leg 604.

Figure 14:
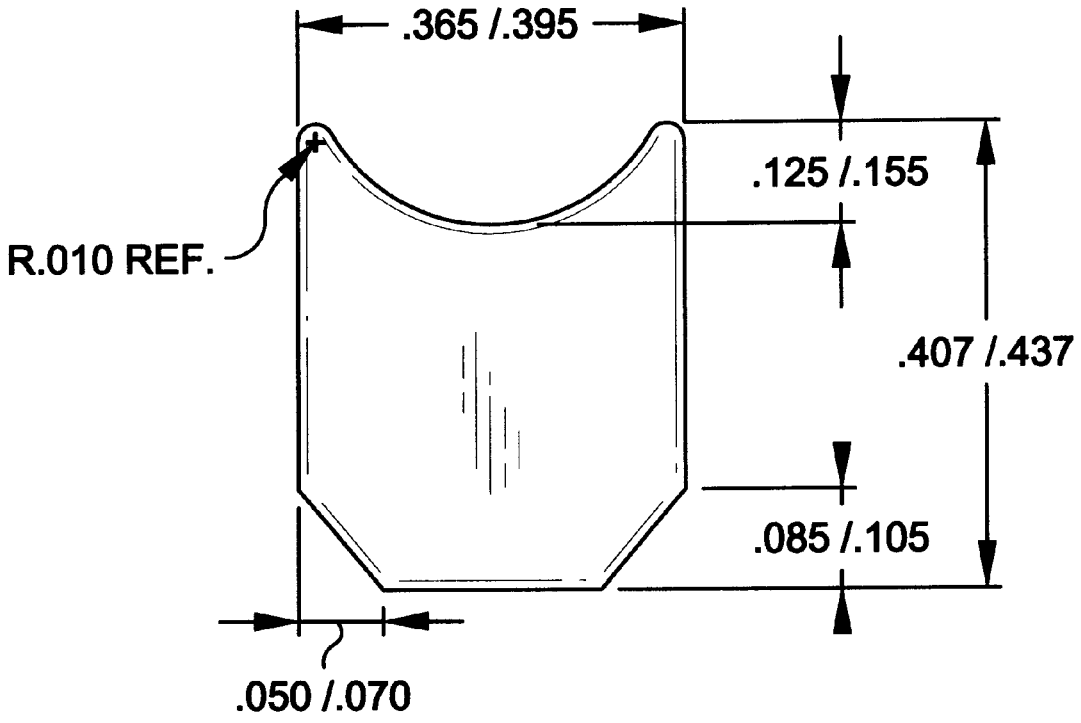
FIG. 14 is a cross-section view of a flange-less insert.

FIG. 14 shows an alternative flange-less insert that may be used in place of inserts 510 or 610 discussed above. This insert may be made of a plastic, such as "Santoprene". This figure is drawn at approximately 5× scale, and minimum/maximum dimensions in inches are provided for the insert.

FIGS. 10A, 10B, 11A and 11B are drawn at about twice full scale of the actual size of the components and show the preferred sizes of the components. However, other sizes of components, as well as the relative sizes between components, are within the scope of the present invention, as will be appreciated by those skilled in the art.

Figure 12A:
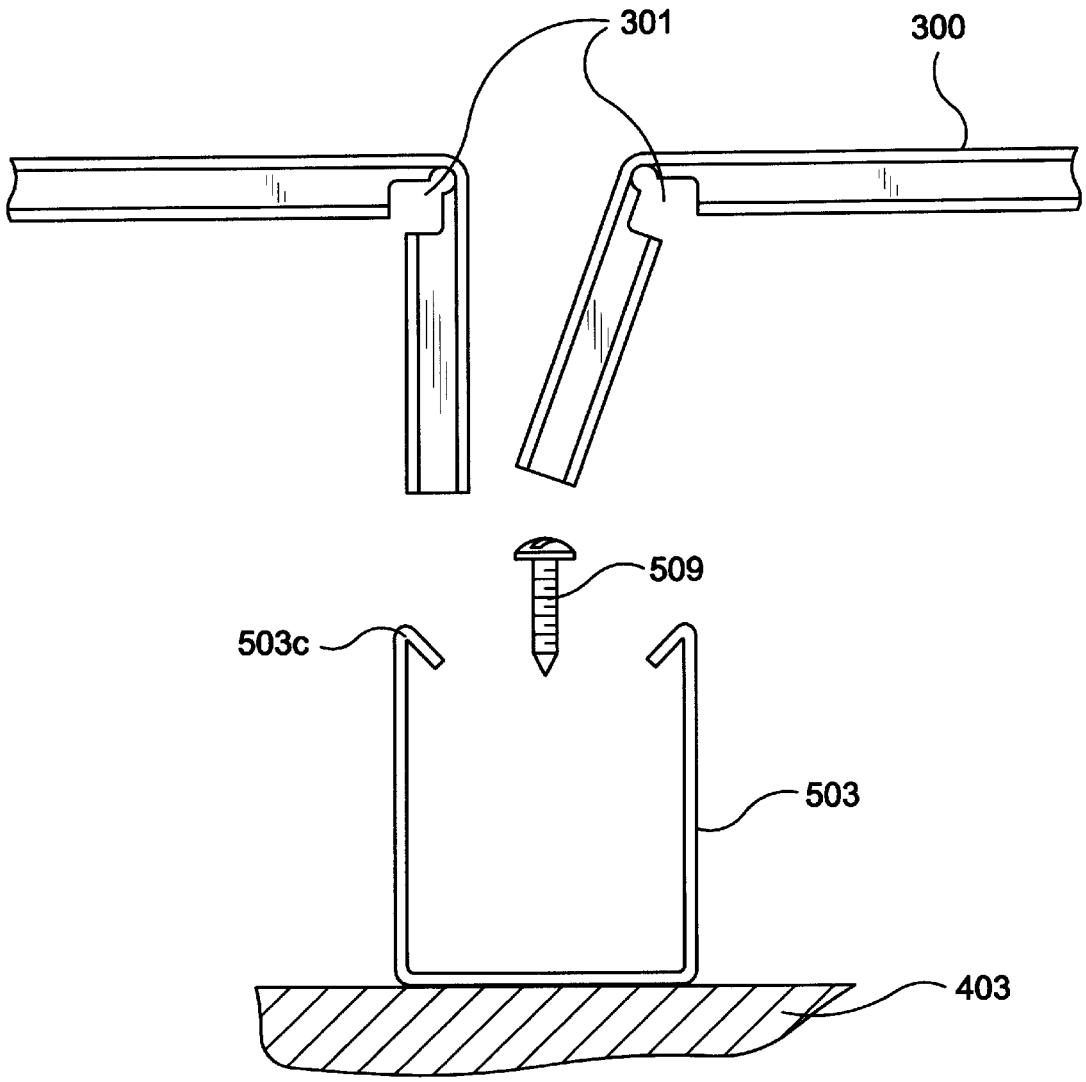
FIGS. 12A–12E are cross-section views of a method of attaching panels to a wall in a double panel joint according to the present invention.
Figure 12B:
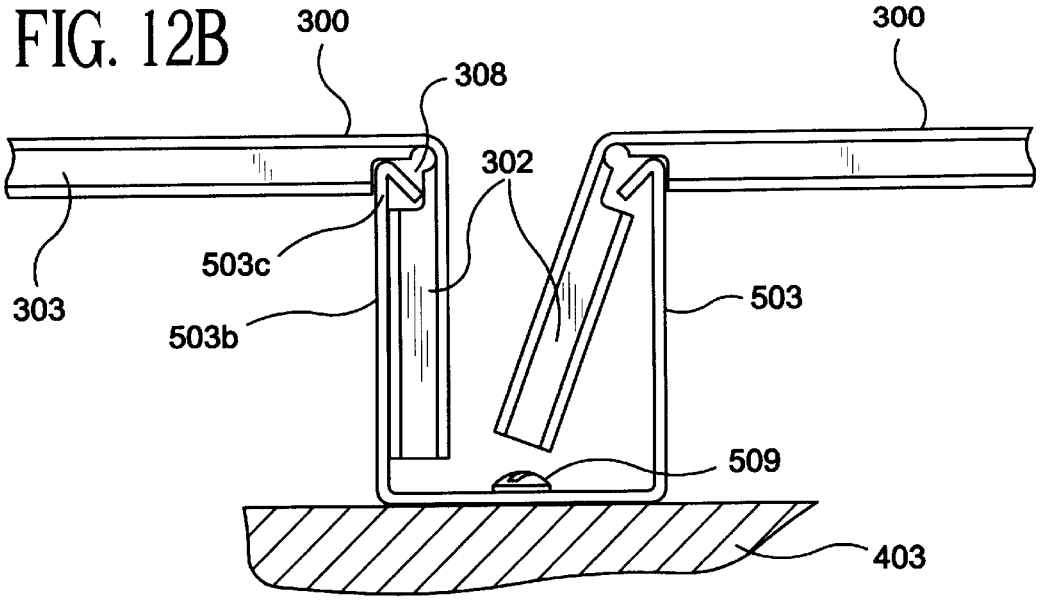
Figure 12C:
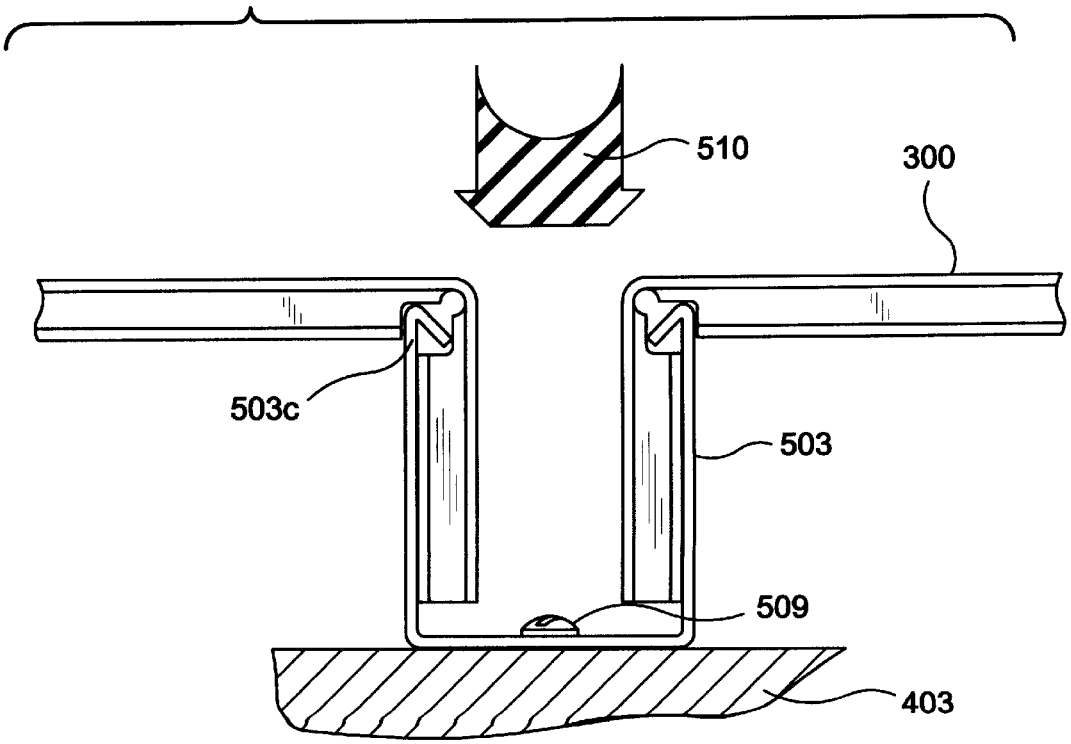
Figure 12D:
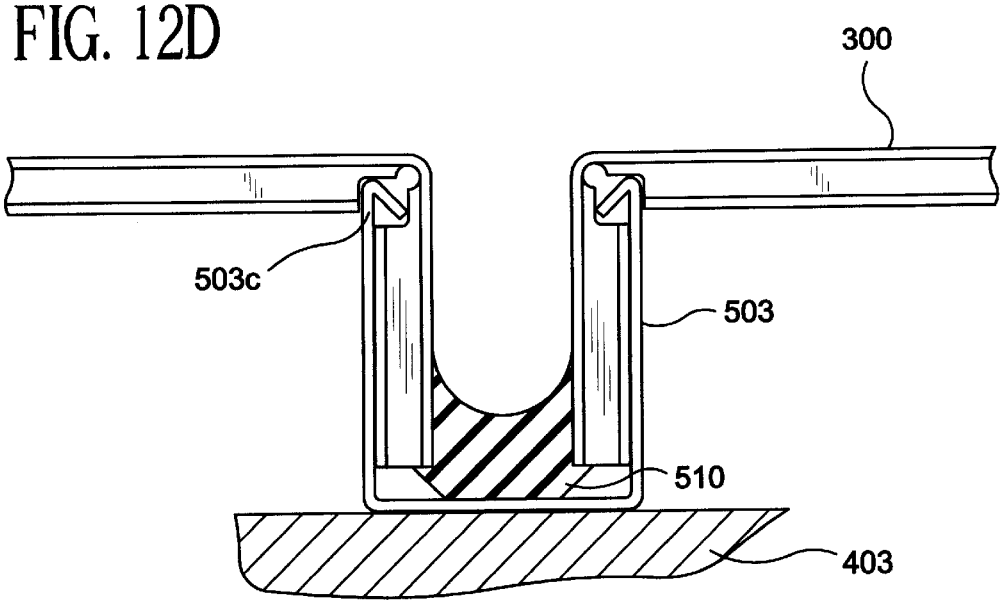
Figure 12E:
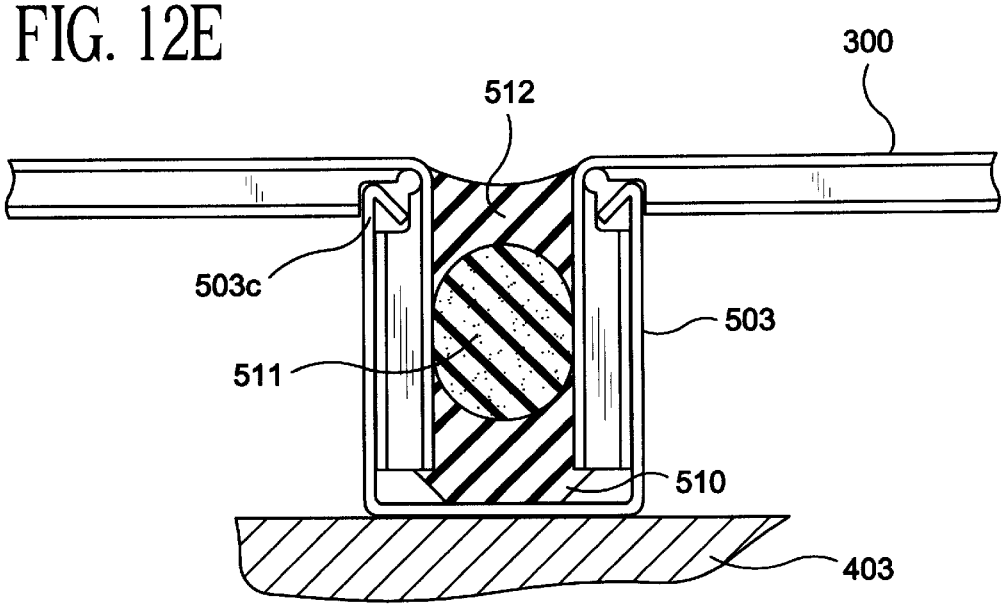

FIGS. 12A–12E show a method of positioning two edge panel portions of a double panel joint within a channel. In FIG. 12A, the channel 503 is attached to the building wall or stud 403 by screwing, riveting or otherwise inserting fasteners 509 through the fastening holes (not shown) in the channel. A first panel edge portion 302 is partially bent around the groove toward the inner surface of the panel, forming a partially-bent down turned edge, which in turn is inserted between the channel rails 503*b*. The partially-bent down-turned edge may then be fully turned so that the hook end 503*c* fully engages the cavity 308 formed by the groove 301. At that time, the down-turned edge is substantially perpendicular to the main panel portion 303 and abuts the channel rail 503*b* (see leftward panel of FIG. 12B). The width of the edge panel portion is dimensioned to be less than the height of the channel rail 503*b* so that the down-turned edge 302 clears the head of the fastener 509 when it is being turned toward the channel rail 503*b*. A second edge panel portion is inserted and positioned against the other hook 503*c* in similar fashion to the first panel edge portion (see rightward panel of FIG. 12B). Once the two panel edge portions are in place, an insert 510 is wedged or otherwise inserted between the down-turned panel edges so that the flanges 510*a* of the insert 510 snap into place below the bottom of the panel edges, as shown in FIGS. 12C and 12D. As noted above, a flange-less insert, such as the one shown in FIG. 14, may be used in place of the flanged insert 510. Note that the inserts have cutout portions (not shown) to cover the head of the fastener 509. A vinyl backer rod 511 is then inserted into the channel space over the insert 510, and flexible sealant 512 is applied thereon. The flexible sealant cures to form a water-tight joint.

The engagement of the hook in the cavity and the insertion of the insert positively and completely interlock the panel to the channel, and under most building operating conditions, the panel and channel cannot be disengaged. This positive and complete interlocking of the panel to the channel prevents structural failure of the attachment system even under extreme weather conditions. Moreover, using spring-like channels permits the panels to move freely and noiselessly when they undergo thermal expansion and contraction, as shown in FIGS. 13A and 13B.

Figure 13A:
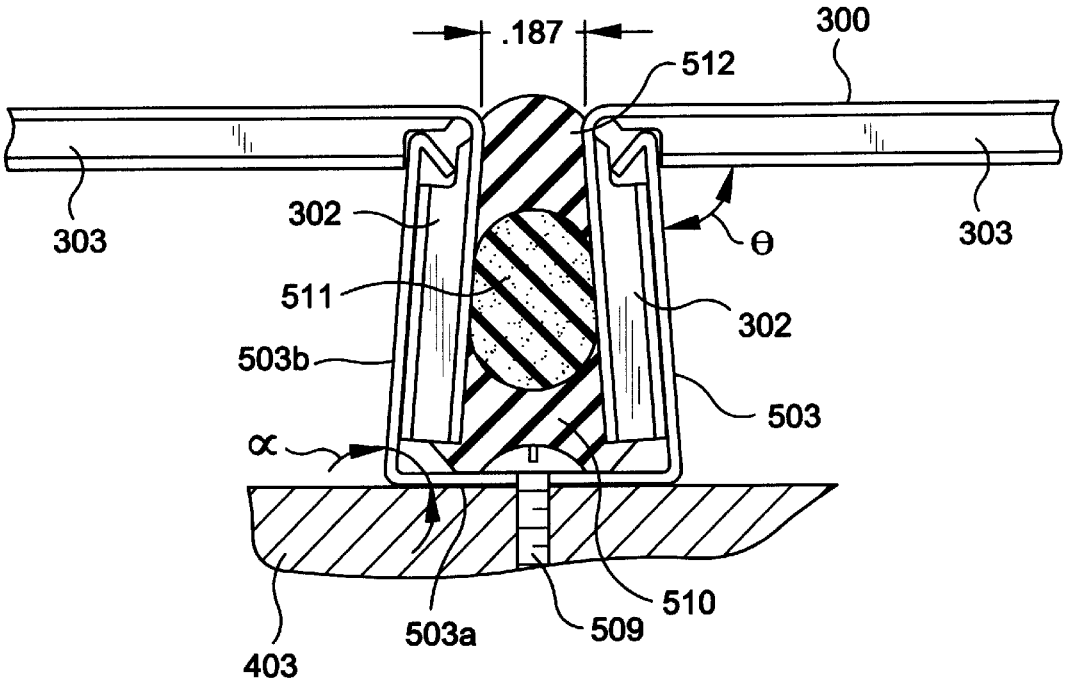
FIGS. 13A and 13B are cross-section views of a double panel joint made according to the present invention respectively undergoing thermal expansion and contraction.
Figure 13B:
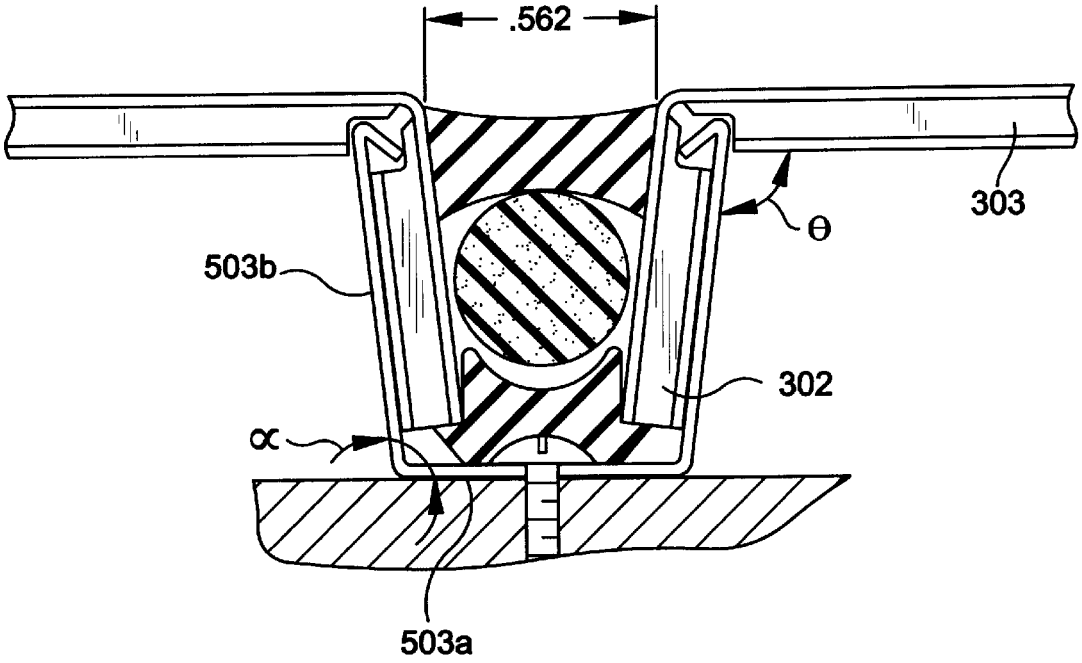

FIGS. 13A and 13B, drawn at approximately twice-full scale, are cross-section views of a double panel joint undergoing thermal expansion and contraction respectively. In FIG. 13A, because of thermal expansion, the angle $\alpha$ between each channel rail 503*b* and channel body 503*a* is less than 90 degrees, as well as the angle $\theta$ between the down-turned edges 302 and the respective main panel portions 303. In this example, the gap between the panels has narrowed from 0.375 inches to 0.187 inches. Importantly, because of the spring-like channel, the hooked ends remain fully engaged in their respective cavities even though the panels have moved. Further, the compressibility of the sealant 512, backer rod 511 and spacer 510 permit free and noiseless movement and provide a water-tight seal.

In FIG. 13B, because of thermal contraction, the angle $\alpha$ between each channel rail 503*b* and channel body 503*a* is greater than 90 degrees, as well as the angle $\theta$ between the down-turned edges 302 and their respective main panel portions 303. In this case, the gap between the panels has expanded from 0.375 inches to about 0.562 inches. The spring-like channel again allows the hooked ends to remain fully engaged in their respective cavities, and the elasticity of the sealant 512 maintains a water-tight seal. The insert also maintains its function of pressing the bottoms of the panel edges against the hooked-end channel rails.

Importantly, in both thermal expansion and contraction, the spring-like characteristic of the channels ensures that the panels remain engaged with the channel at the hook ends. The same functionality is provided, of course, to the single panel joint channel 603. As will be appreciated, in that case, the leg 604 thereof remains abutting the side of the wall while the channel rail 503*b* springs back or forth.

In addition, the ends of the channel rails need not be hook-shaped, and may instead take other shapes contoured to fit the cavity, so long as they can extend into the cavity and engage the cavity in a positive and interlocking fashion. Also, the cavity need not be rectangular in shape, but may be configured to more fully engage the ends of the channel rails, whatever their shape may be. For example, the rail end may be cylindrical in shape, the groove being formed in the panel so as to form a cavity, when the panel is bent, that engages the cylindrical rail end.

Of course, it will be appreciated that the invention may take forms other than those specifically described. All above-recited dimensions are exemplative, and may be varied to accomplish the invention in other ways and in other forms. Regardless, the scope of the invention is to be determined solely by the following claims.

What is claimed is:

1. A system for attaching at least one panel to a wall, said system comprising said at least one panel and an elongated channel, said at least one panel comprising:

a main panel portion;

a panel edge portion; and a groove between said main panel portion and said panel edge portion, the groove having a plurality of surfaces, said panel edge portion capable of being bent around said groove toward said main panel portion to form a cavity, said cavity having a cavity wall formed by said plurality of surfaces;

and said elongated channel comprising:

a body, said body being attachable to the wall by a fastener; and a pair of rails integrally formed with said body, said pair of rails extending substantially perpendicularly from said body in the same direction, and at least one of said rails ending in a flange contoured to engage said cavity.

2. A system according to claim 1, further comprising an insert for insertion between said two rails after said at least one panel has been positioned in said channel.

3. A system according to claim 2, further comprising a backing rod inserted over said insert.

4. A system according to claim 3, further comprising a flexible sealant applied over said backing rod.

5. A method for attaching a panel to a wall using an elongated channel, the panel comprising a main panel portion, a panel edge portion and a groove therebetween, the channel comprising a body and a pair of rails integrally formed with the body, the pair of rails extending substantially perpendicularly from the body in the same direction, and at least one of the rails ending in a flange contoured to engage a cavity formed by the groove when the panel edge portion is bent around the groove toward the at least one rail, said method comprising the steps of:

fastening the body of the channel to the wall using a fastener;

partially bending the panel edge portion around the groove toward the main panel portion;

inserting the partially-bent panel edge portion between the pair of rails so that the flange of the rail abuts the groove; and further bending the panel edge portion around the groove and toward the rail so as to engage the flange.

6. A system for attaching at least one panel to a wall, said system comprising said at least one panel and an elongated channel, said at least one panel comprising:

a main panel portion;

a panel edge portion, wherein said panel edge portion is capable of being bent toward said main panel portion to form a cavity therebetween;

and said elongated channel comprising:

a body, said body being attachable to the wall by a fastener; and a pair of rails integrally formed with said body, said pair of rails extending substantially perpendicularly from said body in the same direction, and at least one of said rails ending in a flange contoured to engage said cavity.

* * * * *